US010280553B2

(12) United States Patent
Shin et al.

(10) Patent No.: US 10,280,553 B2
(45) Date of Patent: May 7, 2019

(54) DRAIN PUMP AND CLOTHES DRYER HAVING A DRAIN PUMP

(71) Applicant: LG ELECTRONICS INC., Seoul (KR)

(72) Inventors: Jinhyouk Shin, Seoul (KR); Sungjun Kim, Seoul (KR); Minseong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 196 days.

(21) Appl. No.: 15/521,188

(22) PCT Filed: Oct. 22, 2015

(86) PCT No.: PCT/KR2015/011176
§ 371 (c)(1),
(2) Date: Apr. 21, 2017

(87) PCT Pub. No.: WO2016/064206
PCT Pub. Date: Apr. 28, 2016

(65) Prior Publication Data

US 2017/0350064 A1 Dec. 7, 2017

(30) Foreign Application Priority Data

Oct. 24, 2014 (KR) ..... 10-2014-0145245

(51) Int. Cl.
*F04D 1/00* (2006.01)
*D06F 39/08* (2006.01)
(Continued)

(52) U.S. Cl.
CPC ..... *D06F 58/22* (2013.01); *D06F 39/085* (2013.01); *D06F 58/02* (2013.01); *D06F 58/24* (2013.01);
(Continued)

(58) Field of Classification Search
CPC ..... D06F 58/22; D06F 39/085; D06F 58/02; D06F 58/24; D06F 28/20; D06F 58/206; F04D 1/00; F04D 13/02; F04D 29/4293
(Continued)

(56) References Cited

U.S. PATENT DOCUMENTS 5,226,203 A * 7/1993 Sacconato ..... D06F 58/24 34/282
5,743,281 A * 4/1998 Sargeant ..... A47L 15/0084 134/176
(Continued)

FOREIGN PATENT DOCUMENTS

CN 1328218 12/2001
CN 101187137 5/2008
(Continued)

OTHER PUBLICATIONS

Chinese Office Action dated Sep. 5, 2018 with English Translation.
(Continued)

*Primary Examiner* — Stephen M Gravini
(74) *Attorney, Agent, or Firm* — Ked & Associates LLP

(57) ABSTRACT

A drain pump is provided that may include a pump motor; an impeller connected to a rotational shaft of the pump motor. The impeller may include a circular hub, an impeller shaft that extends from a center of a lower surface of the hub, and a plurality of blades that extends from an outer circumferential surface of the impeller shaft and the lower surface of the hub in a radial direction of the hub. The hub may have a longitudinal cross section in which a thickness of the hub gradually increases from the center of the lower surface toward an edge thereof.

10 Claims, 7 Drawing Sheets

(51) Int. Cl.

| | |
|---|---|
| ***D06F 58/02*** | (2006.01) |
| ***D06F 58/20*** | (2006.01) |
| ***D06F 58/22*** | (2006.01) |
| ***D06F 58/24*** | (2006.01) |
| ***F04D 13/02*** | (2006.01) |
| ***F04D 29/22*** | (2006.01) |
| ***F04D 29/42*** | (2006.01) |

(52) U.S. Cl.
CPC ..... *F04D 1/00* (2013.01); *F04D 29/22* (2013.01); *D06F 58/20* (2013.01); *D06F 58/206* (2013.01); *F04D 13/02* (2013.01); *F04D 29/4293* (2013.01)

(58) Field of Classification Search
USPC ..... 34/82
See application file for complete search history.

(56) References Cited

U.S. PATENT DOCUMENTS

| | | | | |
|---|---|---|---|---|
| 7,510,368 | B2 * | 3/2009 | Stahle | F04D 1/04 415/121.1 |
| 7,886,458 | B2 * | 2/2011 | Blair | B01D 46/0006 134/25.1 |
| 8,051,637 | B2 * | 11/2011 | Labrador | F01K 27/00 60/39.01 |
| 8,438,750 | B2 * | 5/2013 | Dittmer | D06F 58/22 134/10 |
| 8,615,895 | B2 * | 12/2013 | Shin | D06F 58/22 34/606 |
| 8,857,071 | B2 * | 10/2014 | Lee | D06F 58/206 34/85 |
| 9,284,677 | B2 * | 3/2016 | Kwon | D06F 23/06 |
| 9,420,823 | B2 * | 8/2016 | Lee | F26B 9/06 |
| 9,828,715 | B2 * | 11/2017 | Kwon | D06F 58/22 |
| 9,909,249 | B2 * | 3/2018 | Kim | D06F 39/088 |
| 9,982,384 | B2 * | 5/2018 | Shin | D06F 58/20 |
| 10,077,528 | B2 * | 9/2018 | Yoichi | D06F 58/22 |
| 10,087,569 | B2 * | 10/2018 | Bocchino | D06F 58/22 |
| 2011/0277336 | A1 * | 11/2011 | Shin | D06F 58/22 34/130 |
| 2016/0010271 | A1 * | 1/2016 | Shin | D06F 58/20 415/71 |
| 2017/0350064 | A1 * | 12/2017 | Shin | D06F 58/22 |

FOREIGN PATENT DOCUMENTS

| | | | | |
|---|---|---|---|---|
| DE | 29 07 432 | | 9/1980 | |
| EP | 1 887 126 | | 2/2008 | |
| EP | 2 085 619 | | 8/2009 | |
| EP | 2 386 679 | | 11/2011 | |
| EP | 2966215 | A1 * | 1/2016 | D06F 58/20 |
| EP | 2966215 | B1 * | 8/2017 | D06F 58/20 |
| JP | 2010-104404 | | 5/2010 | |
| KR | 10-0521090 | | 10/2005 | |
| KR | 10-2009-0024465 | | 3/2009 | |
| KR | 10-1041824 | | 6/2011 | |
| KR | 10-2011-0125570 | | 11/2011 | |
| KR | 10-1186159 | | 10/2012 | |
| WO | WO 03/072947 | | 9/2003 | |
| WO | WO-2016006900 | A1 * | 1/2016 | D06F 58/20 |

OTHER PUBLICATIONS

International Search Report and Written Opinion dated Jan. 5, 2016 issued in Application No. PCT/KR2015/011176 (Full English Text).
European Search Report dated May 4, 2018.

* cited by examiner

[Fig. 1]
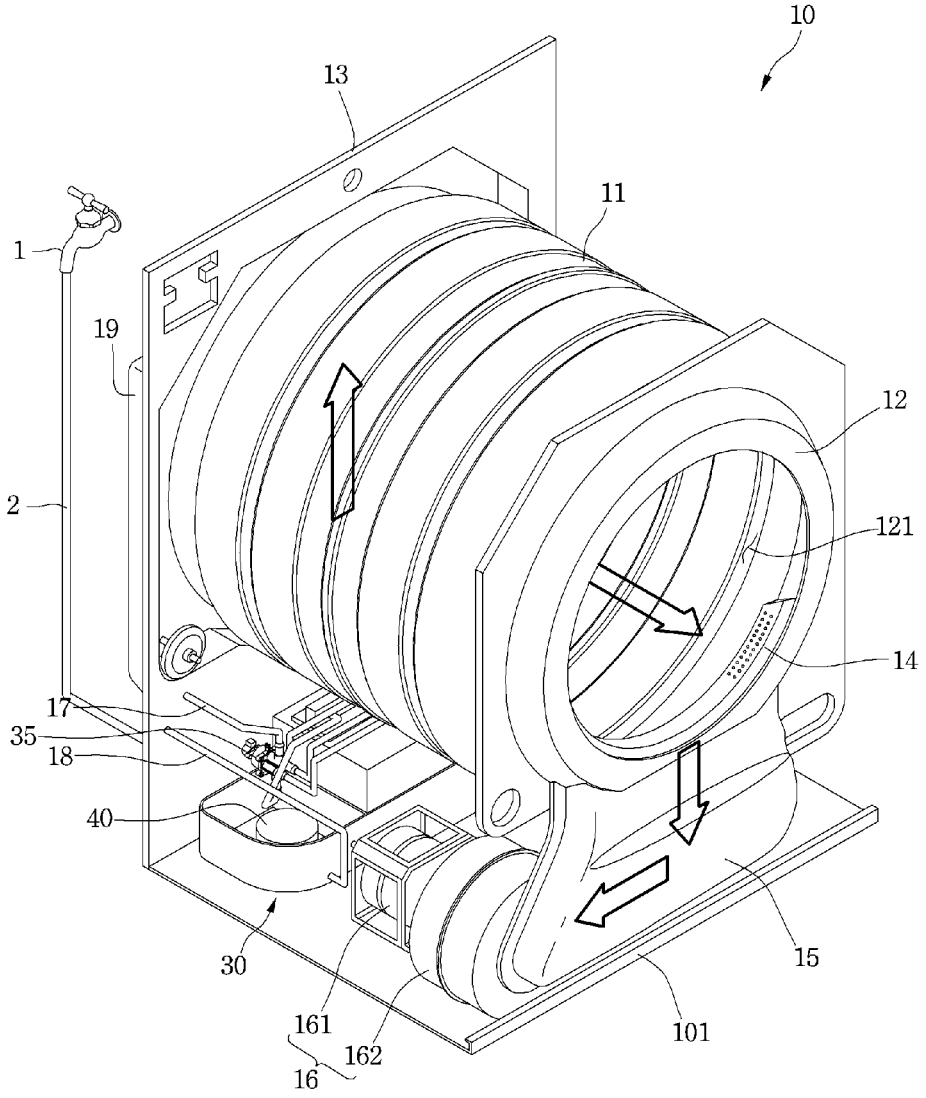

[Fig. 2]
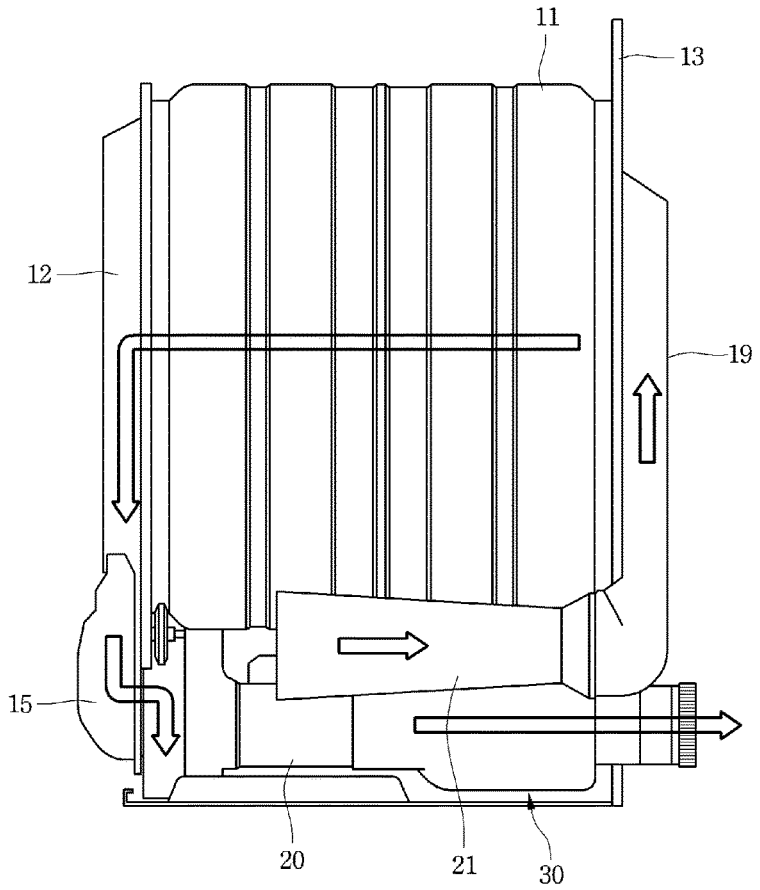
[Fig. 3]
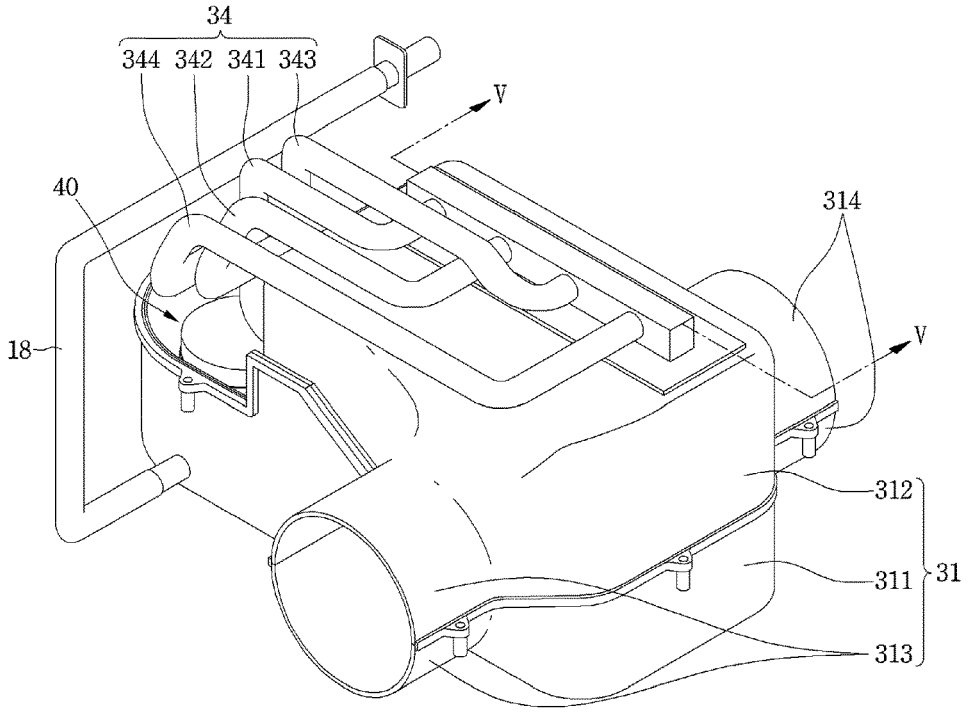

[Fig. 4]
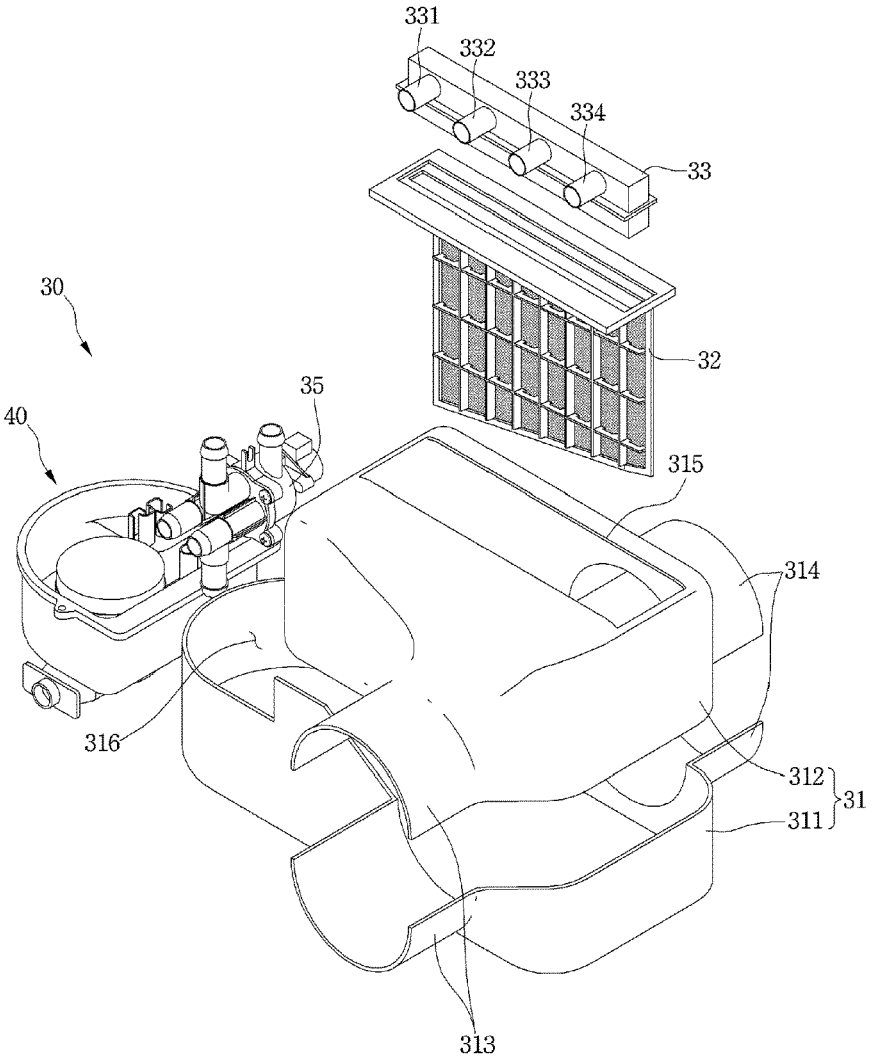
[Fig. 5]
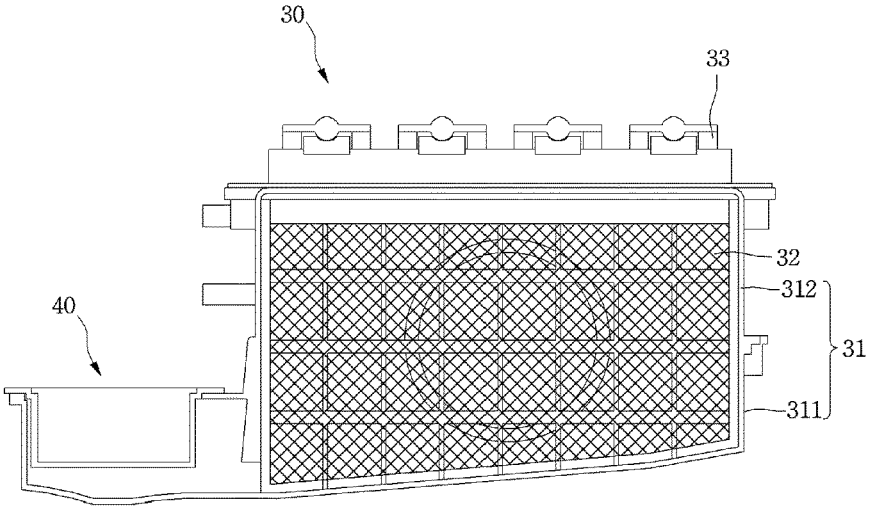

[Fig. 6]
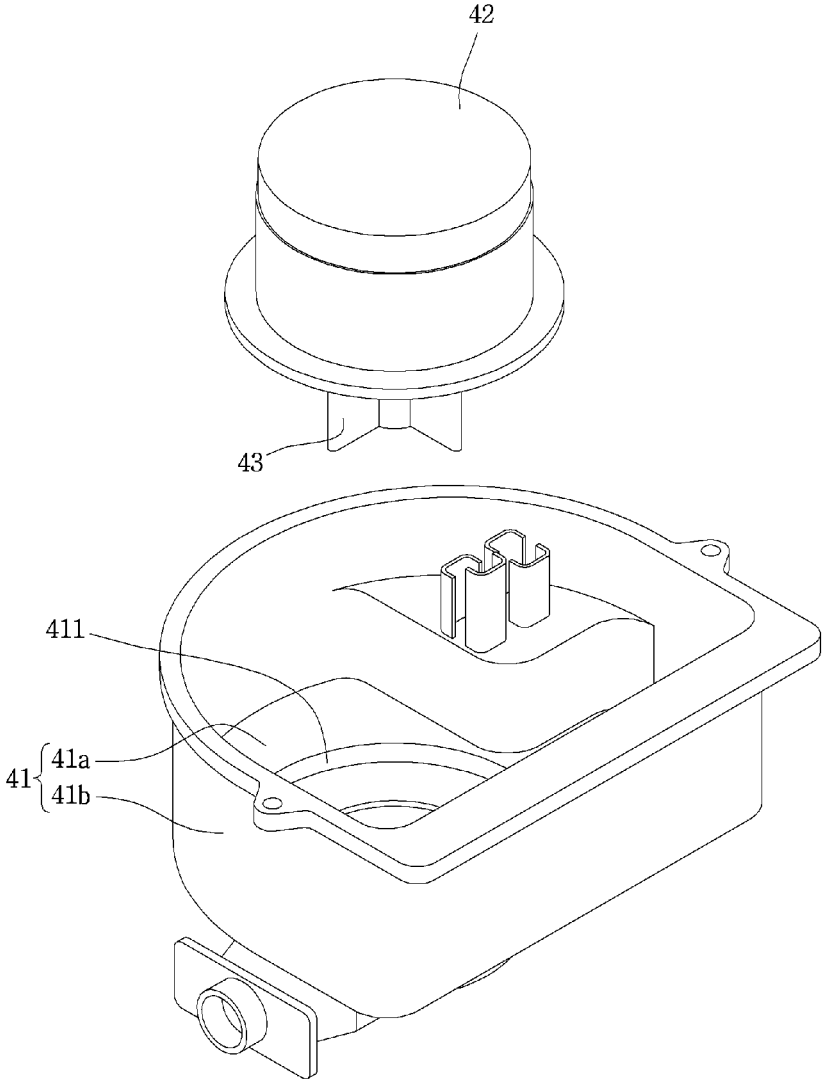

[Fig. 7]
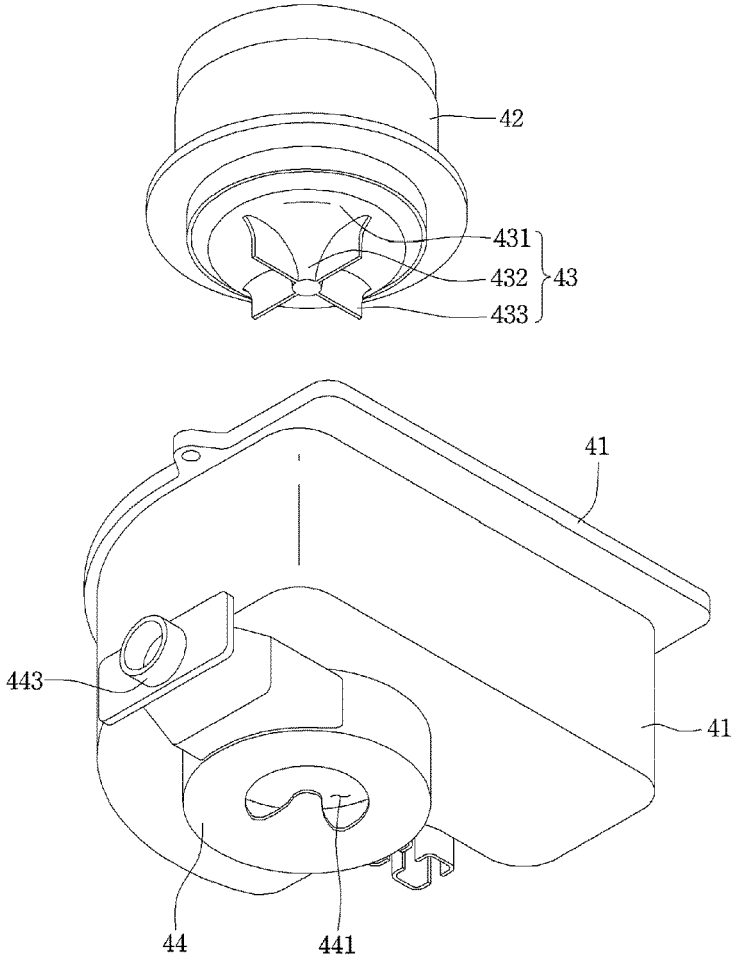
[Fig. 8]
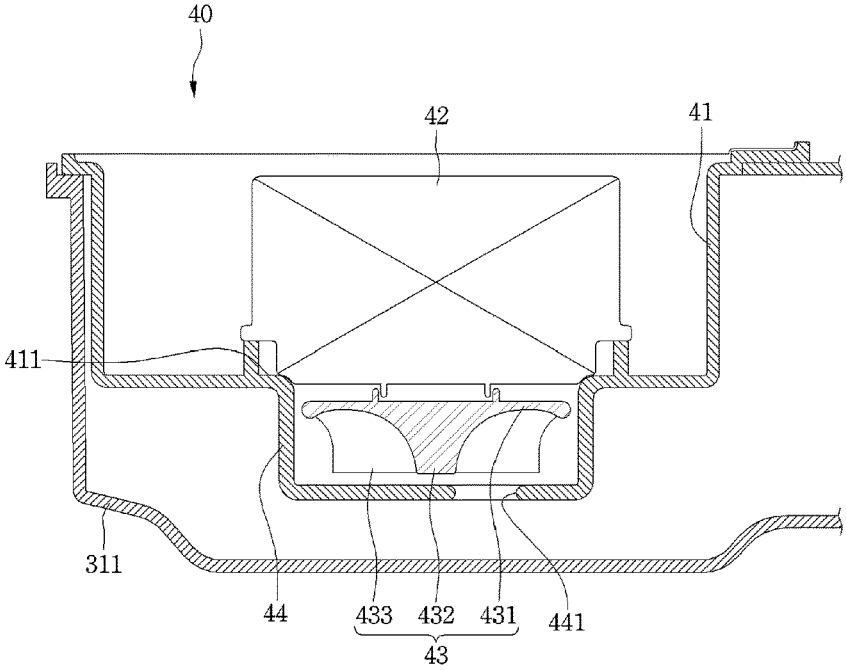

[Fig. 9]
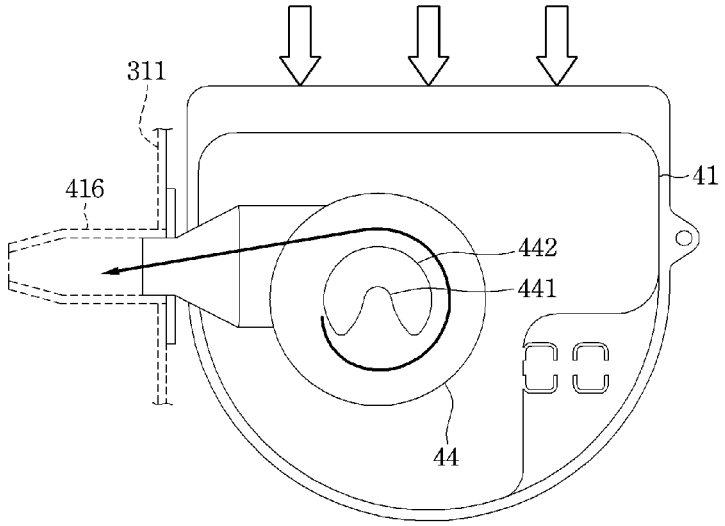
[Fig. 10]
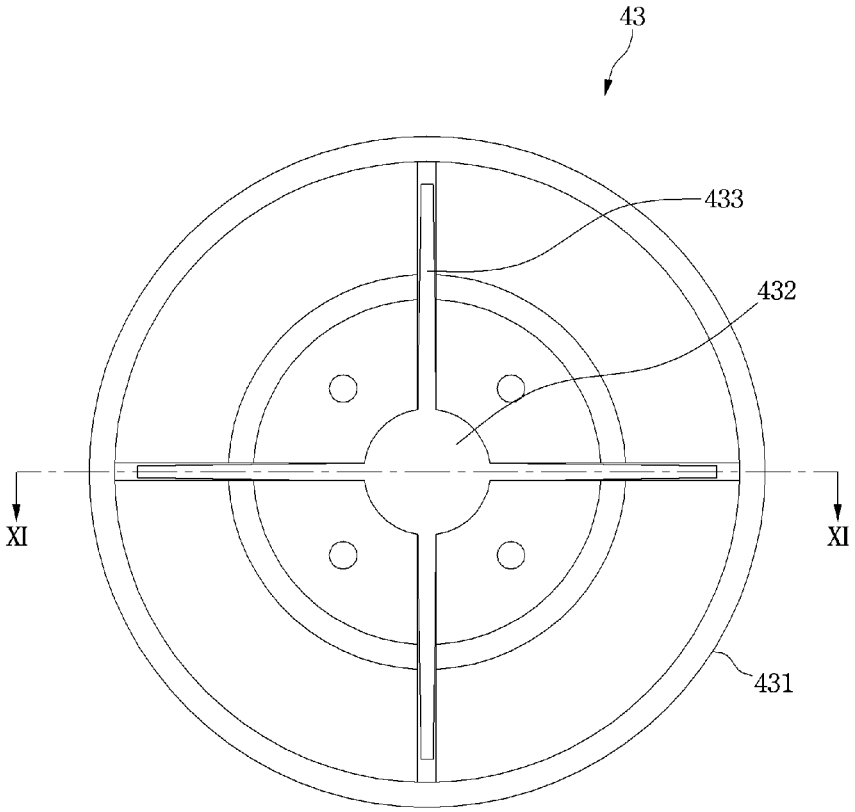

[Fig. 11]
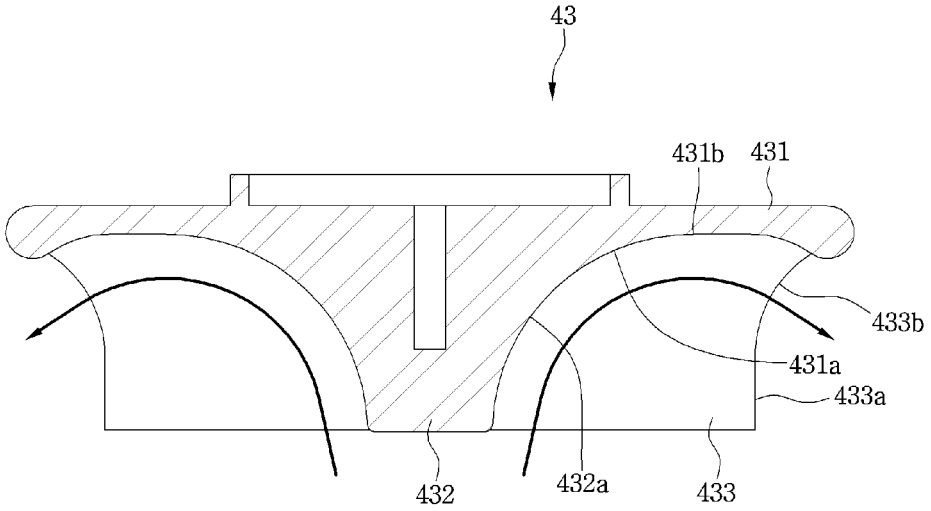

DRAIN PUMP AND CLOTHES DRYER HAVING A DRAIN PUMP

CROSS-REFERENCE TO RELATED PATENT APPLICATIONS

This application is a U.S. National Stage Application under 35 U.S.C. § 371 of PCT Application No. PCT/KR2015/011176, filed Oct. 22, 2015, which claims priority to Korean Patent Application No. 10-2014-0145245, filed Oct. 24, 2014, whose entire disclosures are hereby incorporated by reference.

TECHNICAL FIELD

A drain pump and a clothes dryer having a drain pump are disclosed herein.

BACKGROUND ART

A clothes dryer is a home appliance in which hot air is supplied into a drying drum to remove moisture from clothes or other items to be dried (hereinafter referred to collectively as "clothes"), when an object to be dried is place in the drying drum and the drying drum is rotated. The hot air supplied into the drying drum may be generated by electrical resistance heat or combustion heat using a gas fuel, for example, and supplied into the drying drum using a fan, for example.

The clothes dryer may be classified into a circulating dryer and a ventilating dryer according to a hot air supply system. That is, the circulating dryer is a dryer using a method in which hot air supplied into the drying drum is repeatedly heated and cooled, while circulated in the dryer, and the ventilating dryer is a dryer using a method in which hot air supplied into the drying drum escapes from the drying drum and is then discharged outside of the dryer.

In a drying process, lint may be separated from clothes and float in air discharged from the drying drum, and foreign substances in the clothes may be dropped to a bottom of the drying drum. To remove the lint contained in the air discharged from the drying drum, a lint filter assembly or lint filter may be installed at or in a passage of air discharged from the drying drum.

When the lint is accumulated in the lint filter, a flow of the air may be obstructed, and a load of the fan increased. As a result thereof, a drying performance may be degraded, power consumption may increase, and a breakdown of the fan may result. Further, the lint generated in the drying process may flow into a fan motor or a combustion device installed under the drying drum through a gap between the drying drum and a cabinet, and thus, a fire may be caused in or by the dryer.

To solve the above-mentioned problems, foreign substances accumulated at the lint filter should be periodically removed. In a case of a separable lint filter, a user should periodically separate and clean the lint filter, and then should reinstall the lint filter.

Various methods for easily removing lint accumulated at or on the lint filter have been attempted. Recently, a lint removing structure in which lint is removed using water, while the lint filter is installed in the dryer, has been proposed. For example, in Korean Patent No. 10-1186159 (hereinafter "related art"), which is hereby incorpated by reference, there is disclosed a filter cleaning device of a clothes dryer.

According to the related art, water is sprayed through nozzles provided at a front and a rear of the lint filter, and thus, lint accumulated at or on the lint filter is removed. The water sprayed from the nozzles and a lump of lint separated from the lint filter are introduced into a drain pump and then discharged outside of the dryer.

However, in a case of a conventional drain pump, a clogging phenomenon, in which foreign substances sucked into the drain pump block a suction hole of the drain pump or are wound around an impeller, may be caused while the drain pump is operated. The clogging phenomenon may increase a load of the drain pump, and thus, the drain pump may be damaged by the increase in the load of the drain pump.

DISCLOSURE OF INVENTION

Technical Problem

Embodiments disclosed herein are directed to providing a drain pump capable of solving the above-mentioned problems and a clothes dryer having a drum pump.

Solution to Problem

Embodiments disclosed herein provide a drain pump assembly or drum pump that may include a pump motor, an impeller connected to a rotational shaft of the pump motor, and a housing including a bottom surface portion or bottom surface; a side surface portion or side surface upwardly extending from an edge of the bottom surface portion; and a pump case recessed at a position of the bottom surface portion to accommodate the impeller. A suction hole, through which cleaning water may be suctioned, may be formed at a bottom of the pump case. The impeller may include a circular hub, an impeller shaft configured to extend from a center of a lower surface of the hub, and a plurality of blades configured to extend from an outer circumferential surface of the impeller shaft and the lower surface of the hub in a radial direction of the hub. The hub may have a longitudinal cross section in which a thickness of the hub is gradually increased from the center of the lower surface toward an edge thereof.

Embodiments disclosed herein further provide a clothes dryer including a cabinet, a drying drum accommodated in the cabinet and in which an object to be dried is put, a suction passage configured to supply hot air into the drying drum, a heating means or heater disposed or provided at a point of the suction passage to heat air introduced into the suction passage to a high temperature, an exhaust passage through which hot air discharged from the drying drum may flow, a blower installed at one or a first point of or in the exhaust passage to forcibly flow air in the drying drum, a lint filter assembly or lint filter installed or provided at another or a second point of or in the exhaust passage, and a lint filter cleaning device or cleaner configured to remove lint attached to the lint filter assembly. The lint filter cleaning device may include a cleaning case configured to accommodate the lint filter assembly, a cleaning water supply unit or device disposed or provided at an outside of the cleaning case to spray cleaning water to the lint filter assembly, and a drain pump assembly or drain pump disposed or provided at one side of the cleaning case to drain the cleaning water flowing along the lint filter assembly together with foreign substances attached to the lint filter assembly.

Advantageous Effects of Invention

According to a drain pump assembly or drain pump having the above-described structure and a clothes dryer having a drain pump assembly or drain pump according to embodiments disclosed herein, a phenomenon in which foreign substances contained in cleaning water used to clean a lint filter assembly or lint filter are caught in or block the drain pump may be minimized. More specifically, as the phenomenon in which foreign substances are caught at an entrance side of a drain pump or hairs are wound around an impeller shaft of the drain pump closing an entrance of the drain pump may be minimized, and a possibility in which, due to an increase in load of the drain pump, power consumption may be increased and the drain pump may be damaged may also be minimized.

Further, as the discharge port may be formed in a tangential direction of the pump case, foreign substances may be smoothly discharged. Furthermore, as the hub of the impeller forming the drain pump assembly is formed in a circular plate shape, foreign substances may be prevented from passing over a back side of the impeller and then being wound around the rotational shaft of the pump motor.

BRIEF DESCRIPTION OF DRAWINGS

FIG. 1 is a perspective view of a clothes dryer having a lint filter cleaner according to an embodiment;

FIG. 2 is a side view of the clothes dryer of FIG. 1;

FIG. 3 is a perspective view of the lint filter cleaner according to an embodiment;

FIG. 4 is an exploded perspective view of the lint filter cleaner of FIG. 3;

FIG. 5 is a longitudinal cross-sectional view taken along line V-V of FIG. 3;

FIGS. 6 and 7 are exploded perspective views of a drain pump in the clothes dryer according to an embodiment;

FIG. 8 is a longitudinal cross-sectional view of the drain pump according to an embodiment;

FIG. 9 is a bottom view of the drain pump according to an embodiment;

FIG. 10 is a bottom view of an impeller according to an embodiment; and

FIG. 11 is a longitudinal cross-sectional view taken along line XI-XI of FIG. 10.

MODE FOR THE INVENTION

Hereinafter, a clothes dryer having a lint filter cleaner according to an embodiment will be described with reference to the accompanying drawings. As an example of the clothes dryer having the lint filter cleaner according to an embodiment, a ventilating dryer will be described. However, the lint filter cleaner according to an embodiment may be applied to not only the ventilating dryer, but also to all kinds of clothes dryers including a circulating dryer.

FIG. 1 is a perspective view of a clothes dryer having a lint filter cleaner according to an embodiment. FIG. 2 is a side view of the clothes dryer of FIG. 1.

Referring to FIGS. 1 and 2, a clothes dryer 10 having a lint filter cleaner according to an embodiment may include a drying drum 11, in which an object to be dried may be placed, a front cabinet 12 that supports a front portion of the drying drum 11, a blocking member 14, which may be provided at a bottom of the front cabinet 12, a rear cabinet 13, which may support a rear portion of the drying drum 11, and a lint filter cleaner 30, which may be provided under the drying drum 11.

The clothes dryer 10 may further include a suction duct 21, which may suction in air to be supplied to the drying drum 11, a rear duct 19 which may connect the suction duct 21 with an air introduction hole formed at a rear surface of the drying drum 11, a guide duct 15, which may be connected to a lower surface of the front cabinet 12 to guide the air discharged from the drying drum 11, a blower 16, which may be connected to an outlet end of the guide duct 15, and an exhaust duct 20, which may be connected to an outlet end of the blower 16. The lint filter cleaner 30 may be provided at a certain point of or position within the exhaust duct 20 so that lint contained in the air flowing through the exhaust duct 20 may be filtered while passing through a lint filter provided at or in the lint filter cleaner.

A middle cabinet (not shown) may be provided between the front cabinet 12 and the rear cabinet 13 to cover and protect the drying drum 11 and various components provided under the drying drum 11. The middle cabinet may define both side surfaces and an upper surface of the clothes dryer 10, and a base plate 101, which may define a bottom of the clothes dryer 10, may be provided at a lower surface of the middle cabinet, and components may be installed on the base plate 101.

The blocking member 14 may be provided to prevent foreign substances included with the object to be dried, such as a coin or a ball point pen, which are hard and have a large volume, from being sucked into the guide duct 15 during a drying process. Foreign substances, such as lint, may be filtered by the lint filter, which will be described hereinafter, provided at or in the lint filter cleaner 30, even when introduced into the guide duct 15, and other foreign substances, for example, foreign substances which are hard and have a large volume, may be blocked by the blocking member 14 and remain in the drying drum 11. When the foreign substances other than the lint are sucked into the guide duct 15, the blower 16 may be damaged, or noise may be generated in the exhaust duct 20. Therefore, it is necessary that the foreign substances be prevented from escaping from the drying drum 11 by the blocking member 14, and the blocking member 14 may be separably coupled to the front cabinet 12.

A cleaning water supply pipe 17 and a cleaning water drainpipe 18 may be connected to the lint filter cleaner 30. An inlet end of the cleaning water supply pipe 17 may be provided at the rear cabinet 13, and may be connected with a water supply pipe 2 connected from an external water source 1. An outlet end of the cleaning water supply pipe 17 may be connected to an introduction port of a control valve 35 of the lint filter cleaner 30. An inlet end of the cleaning water drainpipe 18 may be connected to a drain pump 40 of the lint filter cleaner 30.

The blower 16 may include a fan motor 161 and a blower fan 162, which may be connected to a rotational shaft of the fan motor 161. The blower fan 162 may be provided at a side of an outlet end of the guide duct 15 to guide the air, which may pass through the drying drum 11 and be guided to the guide duct 15, to the exhaust duct 20.

In a case of the ventilating dryer, a gas combustion device may be provided at an inlet of the suction duct 21 to heat air introduced into the suction duct 21 to a high temperature. In a case of an electrical dryer, an electric heater may be provided inside of the rear duct 19 to heat the air introduced into the suction duct 21 to a high temperature before the air is introduced into the drying drum 11.

A drying process of the clothes dryer 10 having the above-described structure will be described hereinafter. First, an object to be dried may be placed into the drying drum 11 through a hole 121 provided at the front cabinet 12. When a drying start command is input, the blower 16 may be operated, and air introduced into the suction duct 21 may be heated to a high temperature by the gas combustion device or the electric heater. The air heated to a high temperature may be introduced into the drying drum 11 along a rear duct 19 through a rear surface of the drying drum 11. The high temperature dry air introduced into the drying drum 11, while drying the object to be dried, may be changed into a state of high temperature and humidity. The air of high temperature and humidity may pass through the blocking member 14, while containing lint produced from the object to be dried, and then may be guided to the guide duct 15. The air of high temperature and humidity guided to the guide duct 15 may then be guided to the exhaust duct 20 by the blower 16. While the air of high temperature and humidity guided to the exhaust duct 20 passes through the lint filter cleaner 30, lint may be filtered by the lint filter. The lint filter cleaner 30 may be operated, and lint attached to the lint filter may be separated and then discharged together with cleaning water to an outside by the drain pump 40.

The lint filter cleaner 30 may also be provided in a circulating dryer using a heat pump. More specifically, in the circulating dryer using the heat pump, a heat pump cycle may be provided inside of the cabinet, and air of high temperature and humidity passing through the drying drum 11 may pass through an evaporator of the heat pump cycle. The air changed into a low temperature and dry state by passing through the evaporator, may pass through a condenser of the heat pump cycle, and thus, may be changed into a high temperature and dry state. The high temperature dry air passing through the condenser may be introduced into the drying drum 11 along an air duct through the rear surface of the drying drum 11. The lint filter cleaner 30 may be provided at a certain point of or certain portion in a humid air passage connected to the evaporator so that high temperature humid air passing through the drying drum 11 may pass through the lint filter cleaner 30 before passing through the evaporator, and thus, foreign substances including lint may be filtered by the lint filter. Steam contained in moist air passing through the drying drum 11 may be condensed while passing through the evaporator. Condensed water may be guided to the drain pump 40 of the lint filter cleaner 30. That is, not only is the water provided to clean the lint filter guided to the drain pump 40, but water condensed while passing through the evaporator may be also be guided to the drain pump 40.

Fine foreign substances may be contained in the air passing through the lint filter. The fine foreign substances may adhere to a surface of the evaporator. That is, fine lint may adhere to a pipe of the evaporator and a cooling fin, and the fine lint adhered on the surface of the evaporator may be removed using a separate evaporator cleaning nozzle. The water used to clean the evaporator may also be guided to the drain pump of the lint filter.

Hereinafter, a structure and an operation of the lint filter cleaner 30 will be described with reference to drawings.

FIG. 3 is a perspective view of the lint filter cleaner according to an embodiment. FIG. 4 is an exploded perspective view of the lint filter cleaner of FIG. 3. FIG. 5 is a longitudinal cross-sectional view taken along line V-V of FIG. 3.

Referring to FIGS. 3 to 5, the lint filter cleaner 30 according to an embodiment may include a cleaning case 31 including a lower case 311 and an upper case 312, a lint filter 32, which may be provided inside of the cleaning case 31, a water supply port array 33, which may be provided on an upper surface of the lint filter 32, a water supply pipe array 34, outlet ends of which may be connected to the water supply port array 33, the control valve 35, which may be connected to inlet ends of the water supply pipe array 34, and the drain pump 40, which may be accommodated at one side of an inside of the cleaning case 31. The water supply port array 33, the water supply pipe array 34 and the control valve 35 may be referred to as a cleaning water supply unit or device.

The lint filter 32 may be provided at the inside of the cleaning case 31 to stand vertically. An insertion hole 315, through which the lint filter 32 may pass, may be formed at the upper case 312. A drain pump accommodating portion 316, in which the drain pump 40 may be accommodated, may be formed at one side of the lower case 311.

An introduction port 313, through which the high temperature humid air passing through the drying drum 11 may be introduced, may be formed at one side of the cleaning case 31, and a discharge port 314, through which the high temperature humid air passing through the lint filter 32 may be discharged, may be formed at an opposite surface to a surface at which the introduction port 313 is formed. In addition, cleaning water, which may fall to a bottom of the cleaning case 31 while cleaning the lint filter 32, may flow along the bottom of the cleaning case 31 and be collected toward the drain pump accommodating portion 316.

A drain port 416 may be formed at an outer circumferential surface of the lower case 311 forming the drain pump accommodating portion 316 to extend horizontally. More specifically, a discharge port 443, which will be described hereinafter, may be connected to an inlet end of the drain port 416 extending from a side surface of the lower case 311, and the cleaning water drainpipe 18 may be connected to an outlet end thereof.

The water supply port array 33 may include a plurality of ports which may be provided on an upper surface of the lint filter 32 to be spaced apart from each other at regular intervals. For example, the water supply port array 33 may include first to fourth supply ports 331, 332, 333 and 334; however, embodiments are not limited thereto. The water supply port array 33 may be properly set according to a size of the lint filter 32.

The water supply pipe array 34 may include a plurality of water supply pipes, which may be connected with the water supply port array 33. For example, the water supply pipe array 34 may include first to fourth supply pipes 341, 342, 343 and 344; however, embodiments are not limited thereto. The water supply pipe array 34 may be appropriately set according to a number of supply ports.

FIGS. 6 and 7 are exploded perspective views of a drain pump in the clothes dryer according to an embodiment. FIG. 8 is a longitudinal cross-sectional view of the drain pump according to an embodiment.

Referring to FIGS. 6 to 8, the drain pump 40 of the clothes dryer 10 according to an embodiment may include a housing 41, a pump motor 42, an impeller 43, and a pump case 44. The pump case 44 may be integrally injection-molded with the housing 41 to protrude from a bottom surface of the housing 41.

The housing 41 may be provided at one side of the lower case 311, and may include a bottom **41*a*, and a side surface 41b which may extend upward from an edge of the bottom 41*a*, and a space to accommodate the pump motor 42 may be formed therein. A space to accommodate the housing 41 may be provided at one side of the lower case 311. A bottom of the lower case 311, in which the housing 41 may be accommodated, may be recessed, such that the cleaning water may be collected therein. The bottom of the lower case 311, in which the housing 41 may be accommodated, may be inclined downward toward the drain pump 40, such that cleaning water flowing along the lint filter 32 may flow toward the bottom of the lower case 311 in which the housing 41** is accommodated.

A pump motor support rib 411, on which the pump motor 42 may be seated, may be formed at or on the bottom 41*a* of the housing 41 to extend upward. The pump motor support rib 411 may be round to thus surround an outer edge of the pump motor 42. The bottom 41*a* of the housing 41 corresponding to an inside of the pump motor supporting rib 411 may be recessed downward to have a predetermined depth.

The pump case 44 may be formed to have a size which may accommodate the impeller 43, and may be formed in a cylindrical shape, which may have a predetermined diameter and extend from the bottom 41*a* by a predetermined length. A suction hole 441, through which lint filter cleaning water may be suctioned, may be formed at a bottom of the pump case 44.

A discharge port 443 may be formed to extend from a side surface of the pump case 44. The discharge port 443 may extend in a tangential direction of or from the pump case 44. Therefore, cleaning water may be suctioned through the suction hole 441, and the suctioned cleaning water may be rotated by the impeller 43, and then discharged in the tangential direction of or from the pump case 44. The cleaning water discharged to the discharge port 443 may be discharged to an outside of the clothes dryer 10 through the drain port 416 and the cleaning water drainpipe 18.

The impeller 43 may include a hub 431, an impeller shaft 432, which may extend from a center of the hub 431 by a predetermined length and may be connected to the rotational shaft of the pump motor 42, and a plurality of blades 433 that extends from an outer circumferential surface of the impeller shaft 432 in a radial direction of the hub 431.

FIG. 9 is a bottom view of the drain pump according to an embodiment. Referring to FIG. 9, for example, the suction hole 441 formed at a lower surface of the pump case 44 may have a circular shape; however, embodiments are not limited thereto. A center of the suction hole 441 may coincide with a center of the impeller shaft 432.

A shaft covering portion 442 may be formed to extend from an edge of the suction hole 441 toward the center of the suction hole 441. The shaft covering portion 442 may extend toward the center of the suction hole 441 and have a size which covers an end of the impeller shaft 432.

As the shaft covering portion 442 covers the end of the impeller shaft 432, the foreign substances, such as hair, contained in the cleaning water introduced into the suction hole 441 may be prevented from being wound around the impeller shaft 432. The suction hole 441 may be symmetrical with respect to a line that passes through the center of the impeller shaft 432 and equally divides the shaft covering portion 442, and thus, may have a shape approximating a heart.

Cleaning water suctioned through the suction hole 441 may be rotated with the impeller 43, and discharged in the tangential direction of the pump case 44 through the discharge port 443. In one embodiment, as the cleaning water discharged in the tangential direction of the pump case 44 flows along a horizontal passage, and then is discharged to the cleaning water drainpipe 18, a phenomenon in which a flow of the cleaning water is obstructed by foreign substances, such as hair remaining and accumulating in the passage, may be minimized.

FIG. 10 is a bottom view of an impeller according to an embodiment. FIG. 11 is a longitudinal cross-sectional view taken along line XI-XI of FIG. 10.

Referring to FIGS. 10 and 11, the impeller 43 according to embodiment may include the hub 431, the impeller shaft 432, and the plurality of blades 433, as described above. The hub 431 may be formed in a circular plate shape, and the impeller shaft 432 may extend from a central portion of a lower surface of the hub 431. The plurality of blades 433 may extend from the impeller shaft 432 in a radial direction of the hub 431. The plurality of blades 433 may be spaced apart at regular intervals in a circumferential direction of the hub 431.

A portion 431*a* at which the lower surface of the hub 431 meets the impeller shaft 432 may be rounded with a predetermined curvature. Further, an edge 432*a* of the impeller shaft 432 may be smoothly rounded. Thus, cleaning water suctioned upward through the suction hole 441 may collide with the impeller shaft 432 and the hub 431, and then may be smoothly turned in a radial direction of the impeller 43, and thus, flow resistance may be minimized.

In addition, the lower surface 431*b* of the hub 431 may be rounded, such that a thickness of the hub 431 may gradually increase toward an edge of the hub 431. As shown in FIG. 11, cleaning water may be lifted and then discharged to the outside in the radial direction of the hub 431 by rotation of the impeller 43. At this time, the lifted cleaning water may be guided downward, while being radially discharged along the lower surface of the hub 431, and thus, water and foreign substances may be prevented from being introduced to a rear side of the impeller 43. The rear side of the impeller 43 is a side to which the shaft of the pump motor 42 may be connected with the impeller 43.

An edge of the blade 433 may include a linear portion 433*a*, and an extension portion 433*b* which may be gradually rounded from an end of the linear portion 433*a* toward the outer edge of the hub 431. When the cleaning water is discharged in the radial direction of the hub 431, due to the extension portion 433*b*, resistance may be reduced, and foreign substances may be prevented from being caught by the blade 433.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A drain pump, comprising:

a pump motor;

an impeller connected to a rotational shaft of the pump motor; and a housing including:

a bottom surface;

a side surface that extends from an edge upwardly of the bottom surface; and a pump case recessed from the bottom surface to accommodate the impeller, wherein a suction hole through which cleaning water is suctioned is formed at a bottom of the pump case, and wherein the impeller includes:

a circular hub;

an impeller shaft that extends from a central portion of a lower surface of the hub; and a plurality of blades that extends from an outer circumferential surface of the impeller shaft and the lower surface of the hub in a radial direction of the hub, and wherein the hub has a longitudinal cross section in which a thickness of the hub gradually increases from the central portion of the lower surface toward an edge thereof.

2. The drain pump of claim 1, further including a shaft covering portion that extends from an edge of the suction hole toward a center of the suction hole to cover an end of the impeller shaft.

3. The drain pump of claim 1, further including a discharge port that extends from an outer circumferential surface of the pump case in a tangential direction thereof.

4. The drain pump of claim 1, further including a pump motor supporting rib that protrudes from the bottom surface of the housing, wherein the pump motor supporting rib extends along an upper edge of the pump case.

5. A clothes dryer, comprising:

a cabinet:

a drying drum accommodated in the cabinet and in which an object to be dried is placed;

a suction passage that supplies hot air into the drying drum;

a heater provided in the suction passage to heat air introduced into the suction passage to a high temperature;

an exhaust passage through which hot air discharged from the drying drum flows;

a blower provided at a first position in the exhaust passage to forcibly flow air in the drying drum;

a lint filter installed at a second position in the exhaust passage; and a lint filter cleaner that removes lint adhered to the lint filter assembly, wherein the lint filter cleaner includes:

a cleaner case that accommodates the lint filter;

a cleaning water supply device provided at an outside of the cleaner case to spray cleaning water onto the lint filter; and the drain pump of claim 1, which is provided at one side of the cleaner case to drain the cleaning water flowing through the lint filter together with foreign substances adhered to the lint filter.

6. A drain pump, comprising:

a pump motor;

an impeller connected to a rotational shaft of the pump motor; and a housing including a pump case formed in a bottom surface of the housing to accommodate the impeller, wherein a suction hole through which cleaning water is suctioned is formed at a bottom of the pump case, and wherein the impeller includes:

a hub;

an impeller shaft that extends from a central portion of a lower surface of the hub; and a plurality of blades that extends from an outer circumferential surface of the impeller shaft and the lower surface of the hub in a radial direction of the hub, wherein the impeller and the lower surface of the hub are rounded to direct water suctioned through the suction hole radially and then downward.

7. The drain pump of claim 6, further including a shaft covering portion that extends from an edge of the suction hole toward a center of the suction hole to cover an end of the impeller shaft.

8. The drain pump of claim 6, further including a discharge port that extends from an outer circumferential surface of the pump case in a tangential direction thereof.

9. The drain pump of claim 6, further including a pump motor supporting rib that protrudes from the bottom surface of the housing, wherein the pump motor supporting rib extends along an upper edge of the pump case.

10. A clothes dryer, comprising:

a cabinet:

a drying drum accommodated in the cabinet and in which an object to be dried is placed;

a suction passage that supplies hot air into the drying drum;

a heater provided in the suction passage to heat air introduced into the suction passage to a high temperature;

an exhaust passage through which hot air discharged from the drying drum flows;

a blower provided at a first position in the exhaust passage to forcibly flow air in the drying drum;

a lint filter installed at a second position in the exhaust passage; and a lint filter cleaner that removes lint adhered to the lint filter assembly, wherein the lint filter cleaner includes:

a cleaner case that accommodates the lint filter;

a cleaning water supply device provided at an outside of the cleaner case to spray cleaning water onto the lint filter; and the drain pump of claim 6, which is provided at one side of the cleaner case to drain the cleaning water flowing through the lint filter together with foreign substances adhered to the lint filter.

* * * * *